US005582688A

United States Patent [19]

Bando et al.

[11] Patent Number: 5,582,688

[45] Date of Patent: Dec. 10, 1996

[54] TWIN WIRE FORMER OF PAPER MACHINE

[75] Inventors: Takashi Bando; Kazuhide Sakamoto; Hiromu Masuda, all of Mihara, Japan

[73] Assignee: Mitsubishi Jukogyo Kabushiki Kaisha, Tokyo, Japan

[21] Appl. No.: 346,231

[22] Filed: Nov. 22, 1994

[30] Foreign Application Priority Data

Jan. 28, 1994 [JP] Japan ..... 6-008085

[51] Int. Cl.[6] ..... D21F 1/00

[52] U.S. Cl. ..... 162/301; 162/273; 162/300

[58] Field of Search ..... 162/273, 274, 162/300, 301

[56] References Cited

U.S. PATENT DOCUMENTS

| | | | |
|---|---|---|---|
| 4,790,909 | 12/1988 | Harwood | 162/301 |
| 5,167,770 | 12/1992 | Bubik et al. | 162/301 |
| 5,201,999 | 4/1993 | Field et al. | 162/301 |
| 5,248,392 | 9/1993 | Bando et al. | 162/301 |
| 5,259,929 | 11/1993 | Bubik et al. | 162/301 |
| 5,300,196 | 4/1994 | Kraft | 162/300 |
| 5,389,206 | 2/1995 | Buck et al. | 162/301 |

*Primary Examiner*—Karen M. Hastings
*Attorney, Agent, or Firm*—Wenderoth, Lind & Ponack

[57] ABSTRACT

A twin wire former of a paper machine can perform dewatering gently and symmetrically on the front and back sides of the wet paper, thereby producing paper with good yield and excellent front/back similarity. The twin wire former includes the loops of two wires, and first, second and third dewaterers, having large radii of curvature and disposed inside one and the other of the loops of the wires sequentially alternately between a point where a raw material jet alights on the wires and a couch roll, and the wire-run over this section is diagonal. The first and third dewaterers are disposed inside the loop of the wire and the second dewaterer is disposed inside the loop of the wire. This second dewaterer is pivotable about a point in the vicinity of its rear end, and the couch roll is a solid roll. This couch roll, a transfer suction box and the third dewaterer are mounted on a swing arm and can be pivoted for wire installation.

5 Claims, 7 Drawing Sheets

TWIN WIRE FORMER OF PAPER MACHINE

BACKGROUND OF THE INVENTION

This invention relates to a twin wire former for application to the wire part of a paper machine.

An example of a conventional twin wire former is shown in FIG. 2: dewaterers 5, 7 are inside the loop of a wire 4, and a dewatering zone is configured so that the wire-run constituting the forming zone thereof is substantially vertical. A couch roll 8*a* is a suction roll, and the wet paper is transferred to the wire 4 on the couch roll 8*a*. In FIG. 1, reference numeral 1 denotes a head box, 2 is a raw material jet, 3 is a wire, 10 is a breast roll and 11 is a forming roll.

In another example of a conventional twin wire former shown in FIG. 3, dewaterers 6 and 7 are disposed alternately inside wire loops 3 and 4*b*; the first dewaterer is a roll 10*a* with a small radius of curvature, and as in FIG. 2 the couch roll 8*b* is a suction roll and the wet paper is transferred to the wire 4 as it passes over the couch roll 8*b*.

FIG. 4 shows a further example of a conventional twin wire former. The twin wire former in this case consists of diagonal twin wire loops; dewaterers 5*c*, 6*c*, 7*c* are disposed alternately inside the loops of two wires 3*c*, 4*c*, and the wet paper is transferred to the wire 4*c* on a curved transfer box. The dewaterer 5*c* has a small radius of curvature, and the couch roll 8*c* is a suction roll. The lower wire 4*c* passes around a breast roll 10*c*, the dewaterer 5*c*, a separating suction unit 9*c*, the dewaterer 7*c* and the couch roll 8*c*. The upper wire 3*c* passes around a forming roll 11*c*, the dewaterer 6*c*, and a tension roll 13*c*.

In the twin wire former shown in FIG. 2, because the dewaterers 5, 7 are both disposed inside the loop of the same wire 4, the effect of the dewaterers 5, 7 on the formation of the paper layer is asymmetrical. Also, because the couch roll 8*a* is a suction roll, the initial cost is high and because a large vacuum airflow is required the energy costs are also high. Furthermore, there are problems such as that because the top wire return roll 14*a* is swung up to replace the wires 3 and 4, the height required for the machine is large.

In the twin wire former shown in FIG. 3, because the initial dewatering is performed by the roll 10*a* having a small radius of curvature, this dewatering is sudden. Also, as in the case shown in FIG. 2, because the top wire return roll 14*a* is swung up for replacement of the wires, the height of the machine is large. Furthermore, because there are two suction couch rolls, there are the same problems of the initial cost and the energy costs being high as in the case shown in FIG. 2.

In the twin wire former shown in FIG. 4, the initial dewatering is sudden dewatering with a roll, as in FIG. 3, and as in the cases shown in FIG. 2 and FIG. 3 there are problems associated with the use of the suction couch roll 8.

SUMMARY OF THE INVENTION

An object of this invention is to provide a twin wire former which solves the problems described above by providing at least three dewaterers having large radii of curvature.

To achieve this and other objects, this invention is a twin wire former comprising two wire loops wherein between where the raw material jet alights on the wires and the couch roll at least three stationary dewaterers having large radii of curvature are disposed inside loops of one wire and the other wire equentially alternately, and the wire-run between where the raw material jet alights on the wires and the wire-run extending the above-mentioned section is diagonal.

Also, of the stationary dewaterers a first dewaterer is mounted inside the loops of one wire and a second dewaterer is supported pivotally about a point in the vicinity of its rear end inside the loop of the other wire, further, the couch roll is a solid roll, a curved transfer suction box is disposed behind the couch roll, the other wire moves away from the wet paper over the transfer suction box, and the couch roll and the transfer suction box and the dewaterer in front of the couch roll are mounted on a swing arm and are pivotable for wire replacement.

In this invention, because the radii of curvature of the dewaterers are large and the dewaterers are disposed alternately and diagonally, the dewatering zone can be made long within limited height restrictions, and gentle and front/back symmetrical dewatering can be achieved. Also, by the transfer suction box being provided behind the couch roll, the wet paper can be reliably transferred to one of the wires.

Furthermore, by the second dewaterer being supported pivotally about a point in the vicinity of its rear end and by the couch roll and the dewaterer in front of it and the transfer suction box behind it being swung down, the space between the various devices and slack in the wire loops necessary for wire replacement can be made.

DETAILED DESCRIPTION OF THE PREFERRED EMBODIMENTS

Figure 1:
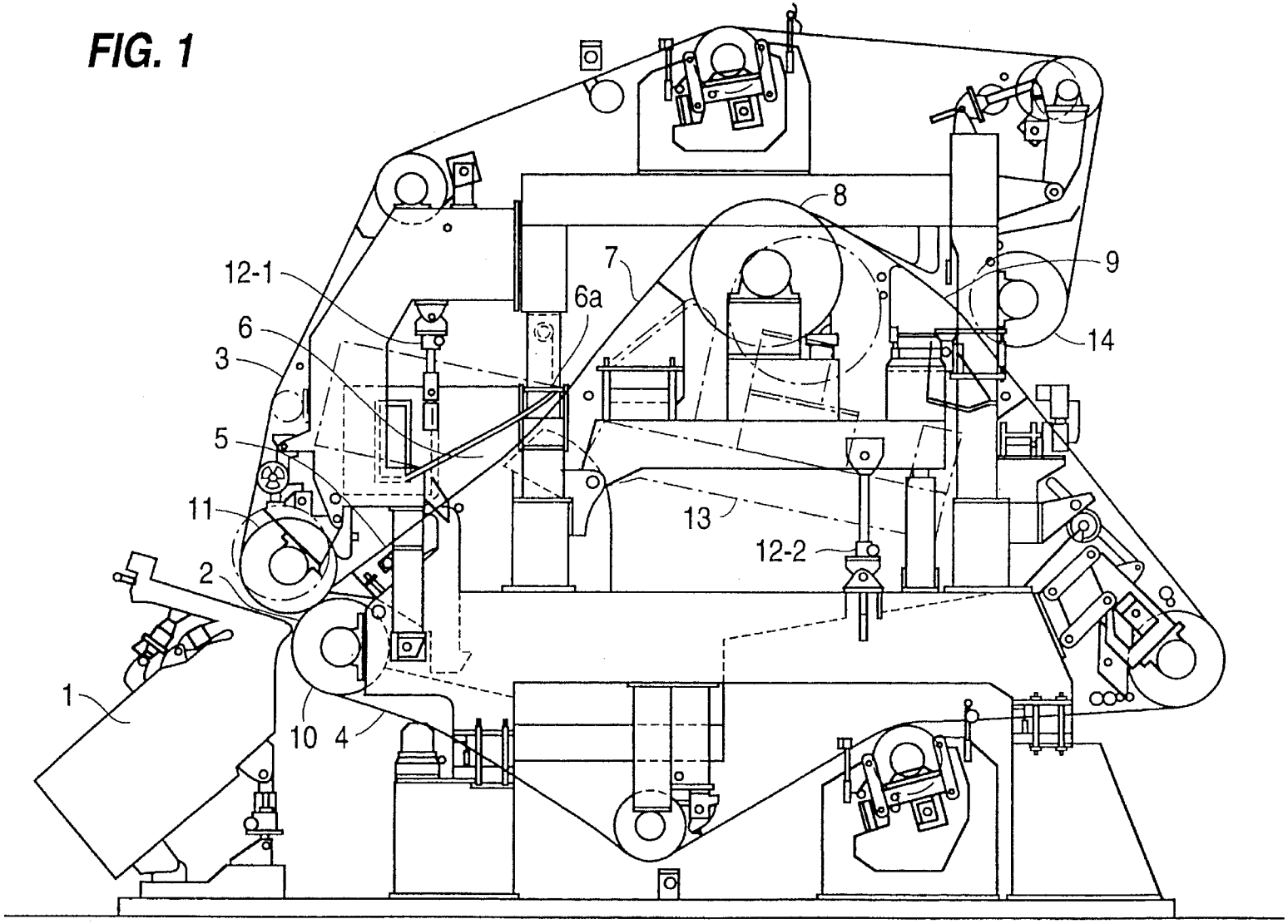
FIG. 1 is a front view of a paper machine twin wire former according to a preferred embodiment of the invention.
Figure 2:
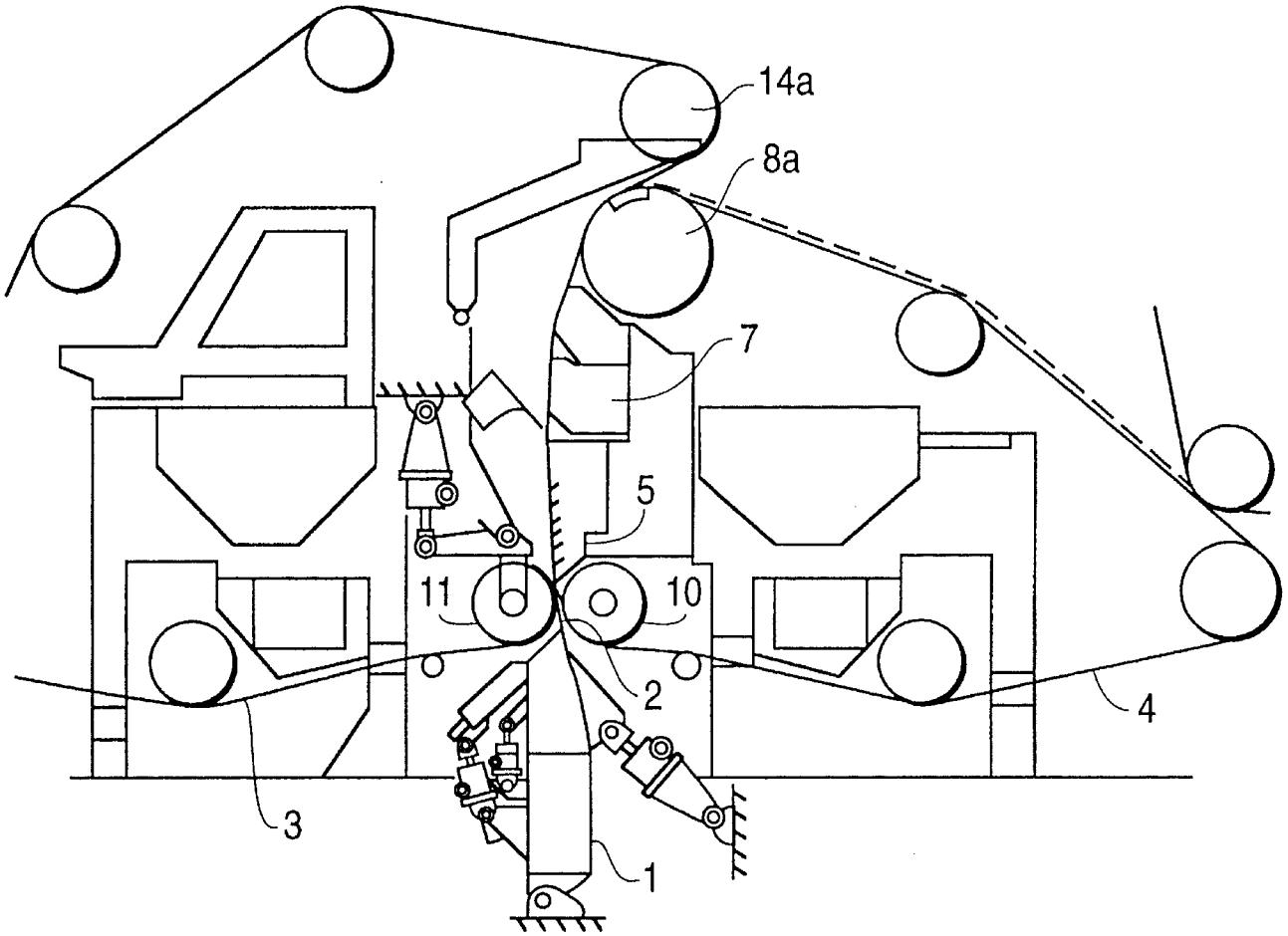
FIG. 2 PRIOR ART
FIG. 2 is a front view of a conventional paper machine twin wire former.
Figure 3:
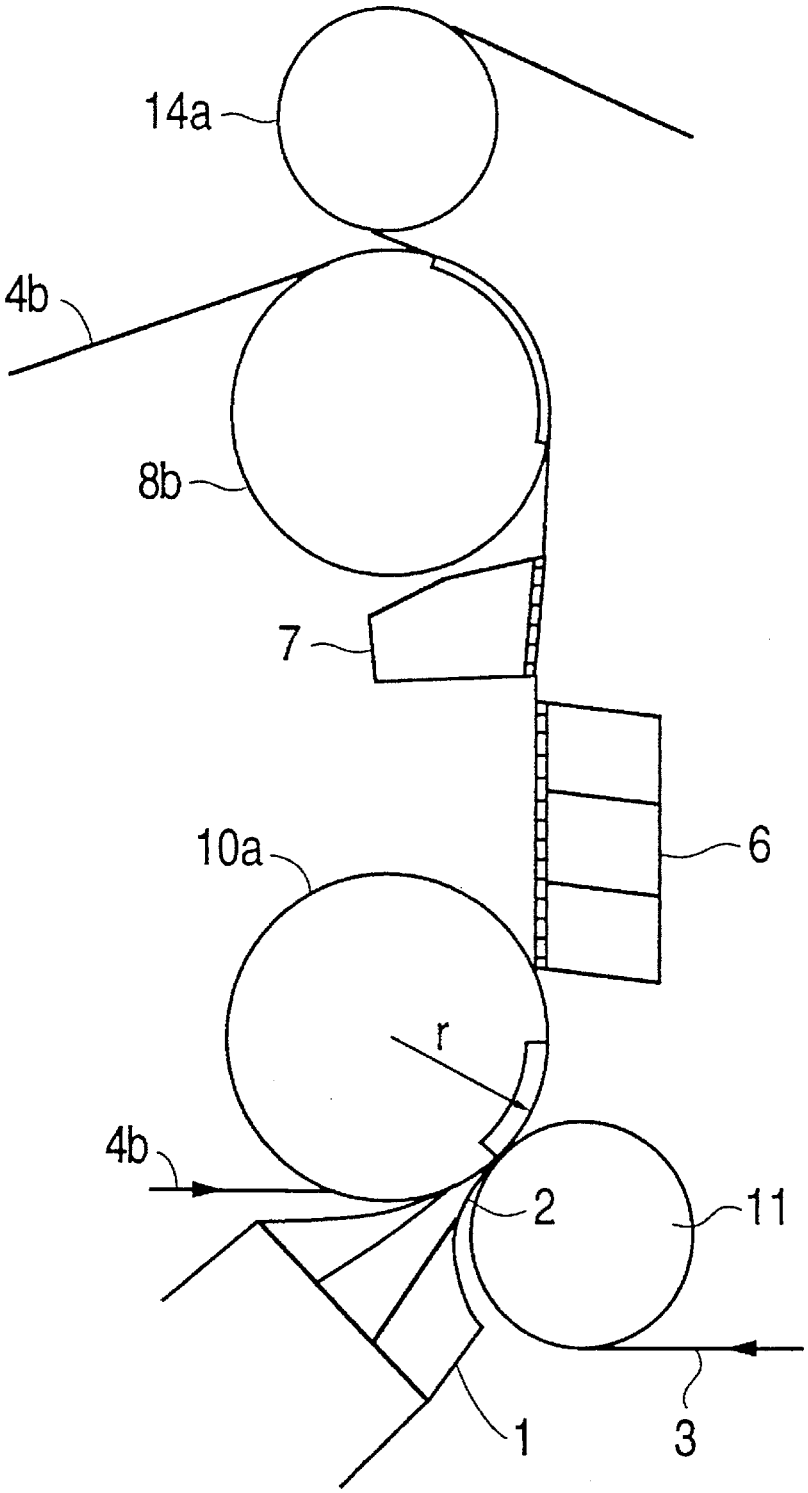
FIG. 3 PRIOR ART
FIG. 3 is a sectional view of a forming and dewatering zone of another conventional example.
Figure 4:
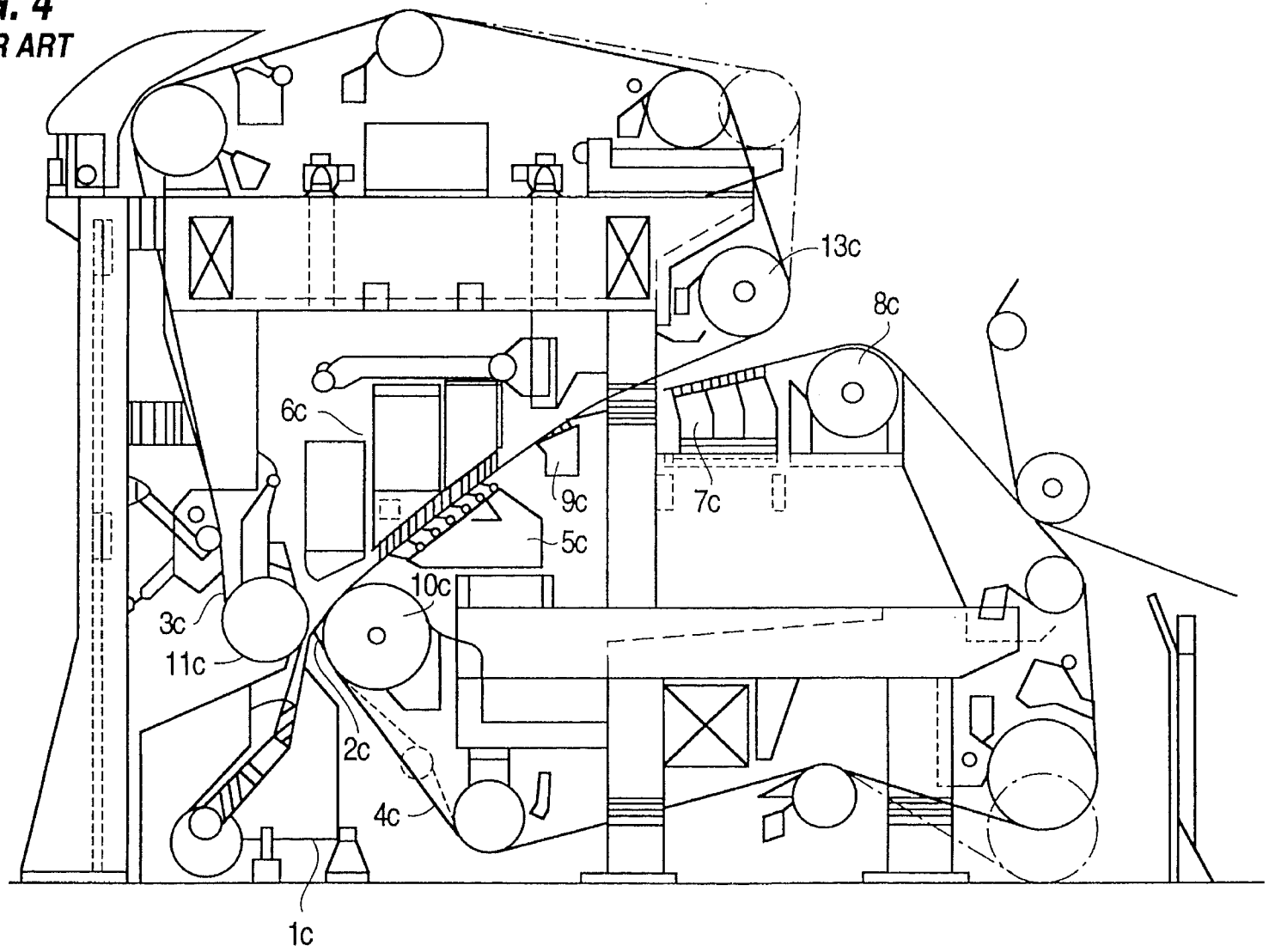
FIG. 4 PRIOR ART
FIG. 4 is a front view of a further example of a conventional paper machine twin wire former.

A preferred embodiment of the invention will now be described, with reference to the accompanying drawings. FIG. 1 shows a preferred embodiment of the invention. In FIG. 1, reference numeral 1 denotes a head box; 2 is a raw material jet; 3 and 4 are wires; and 5, 6 and 7 are first, second and third dewaterers having large radii of curvature, respectively. The first dewaterer 5 is mounted inside the loop of the wire 4, the second dewaterer 6 is mounted inside the loop of the other wire 3, and the third dewaterer 7 is mounted in front of a couch roll 8 inside the loop of the wire 4. The second dewaterer 6 is supported pivotally about a point in the vicinity of its rear end 6*a*, and the first, second and third dewaterers 5, 6, 7 are disposed alternately. The couch roll 8 is a solid roll, and a curved transfer suction box 9 is disposed behind this couch roll 8. Reference numeral 10 denotes a breast roll; 11 is a forming roll; 12-1, 12-2 are worm jacks; 13 is a swing arm which supports the couch roll 8, the transfer suction box 9 and the third dewaterer 7 and has its front end pivotally supported so that it can pivot these components for wire replacement; and 14 is a leadout roll. The worm jack 12-1 is connected to the second dewaterer 6, and the worm jack 12-2 is connected to the swing arm 13.

The raw material jet 2 sprayed out of the head box 1 is sandwiched between the two wires 3 and 4 in front of the first blade of the first dewaterer 5 disposed inside the wire loop 4 and undergoes initial dewatering by a dewatering pressure resulting from the radius of curvature of the blade and tension in the wires. At this time, because the radius of curvature of the first dewaterer 5 is large compared to a roll, the dewatering pressure is low and the dewatering is gentle. The dewaterers shown in FIG. 5 to FIG. 7 can be used as the first dewaterer 5.

The first dewaterer 5 is a conventional one. Describing this with reference to FIG. 5 to FIG. 7, a first blade 15 of the first dewaterer 5 is disposed where the wires 3 and 4 converge; this first blade 15 has a wide surface having a large radius of curvature $R_1$ which curves convexly on the wire 3, 4 side and supports the wire 4, and is removably mounted on a T-bar 5*a* fixed to the first dewaterer 5. The above-mentioned surface of the first blade 15 has multiple grooves provided spaced in the width direction, orthogonal to the direction of travel of the wires, of the kind shown in FIG. 6 or FIG. 7. Grooves 15*a* in FIG. 6 start from a point a distance L from the upstream edge of the blade and with a depth h extend in the travel direction of the wires toward the downstream side and are open at the downstream side of the blade. A land portion 15*c* continuous in the width direction is formed along the leading side of the blade, and this portion of the blade can scrape off water clinging to the wire 4 uniformly in the width direction.

Consequently, when the raw material jet 2 is sandwiched between the wires 3, 4 it is dewatered on both sides through the wires 3, 4 by a dewatering pressure created by tension in the wire 3 and the radius of curvature $R_1$ of the surface of the first blade 15, as mentioned above. White water passing through the wire 4 to the blade side at this time passes along the grooves 15*a* and is discharged through the open ends thereof. The width w and the pitch s of the grooves are fixed at suitable dimensions such that incursion of the wires and width direction dewatering nonuniformity do not occur.

Figure 6:
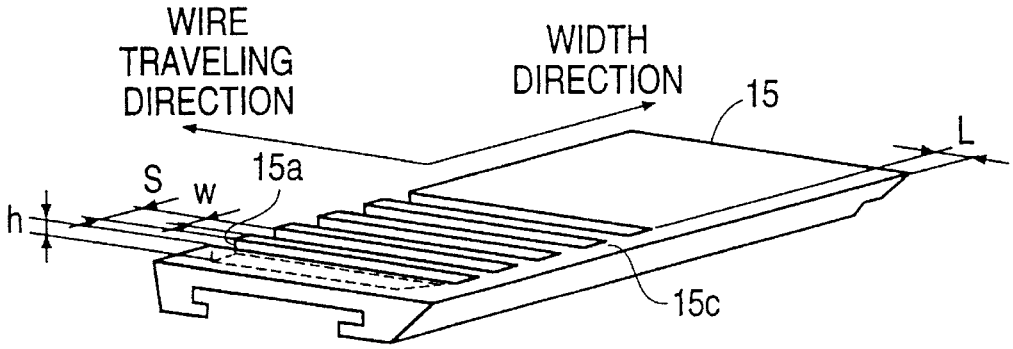
FIG. 6 is a perspective view of a first blade in FIG. 5.
Figure 7:
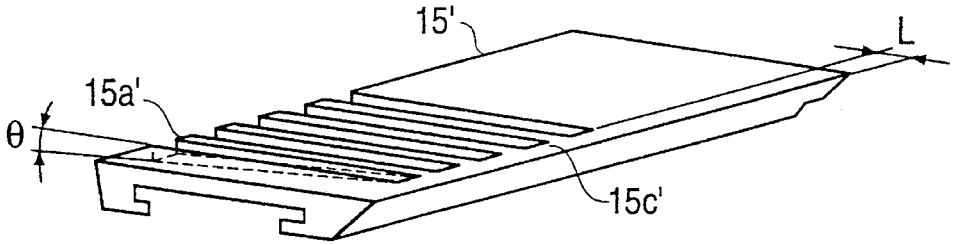
FIG. 7 is a perspective view of a first blade in FIG. 5 different from that of FIG. 6.

FIG. 7 shows another groove shape of a first blade 15'. In FIG. 7, the grooves 15*a'* start at a point a distance L from the leading edge of the blade and extend downstream in the travel direction of the wire, and also slope at an angle B toward the downstream side of the blade. As a result of the grooves 15*a'* having this kind of shape, a vacuum created by a foil effect acts in addition to the dewatering pressure, and dewatering is promoted more than in the case of the grooves 15*a* shown in FIG. 6. Reference numeral 15*c'* denotes a land portion.

Figure 5:
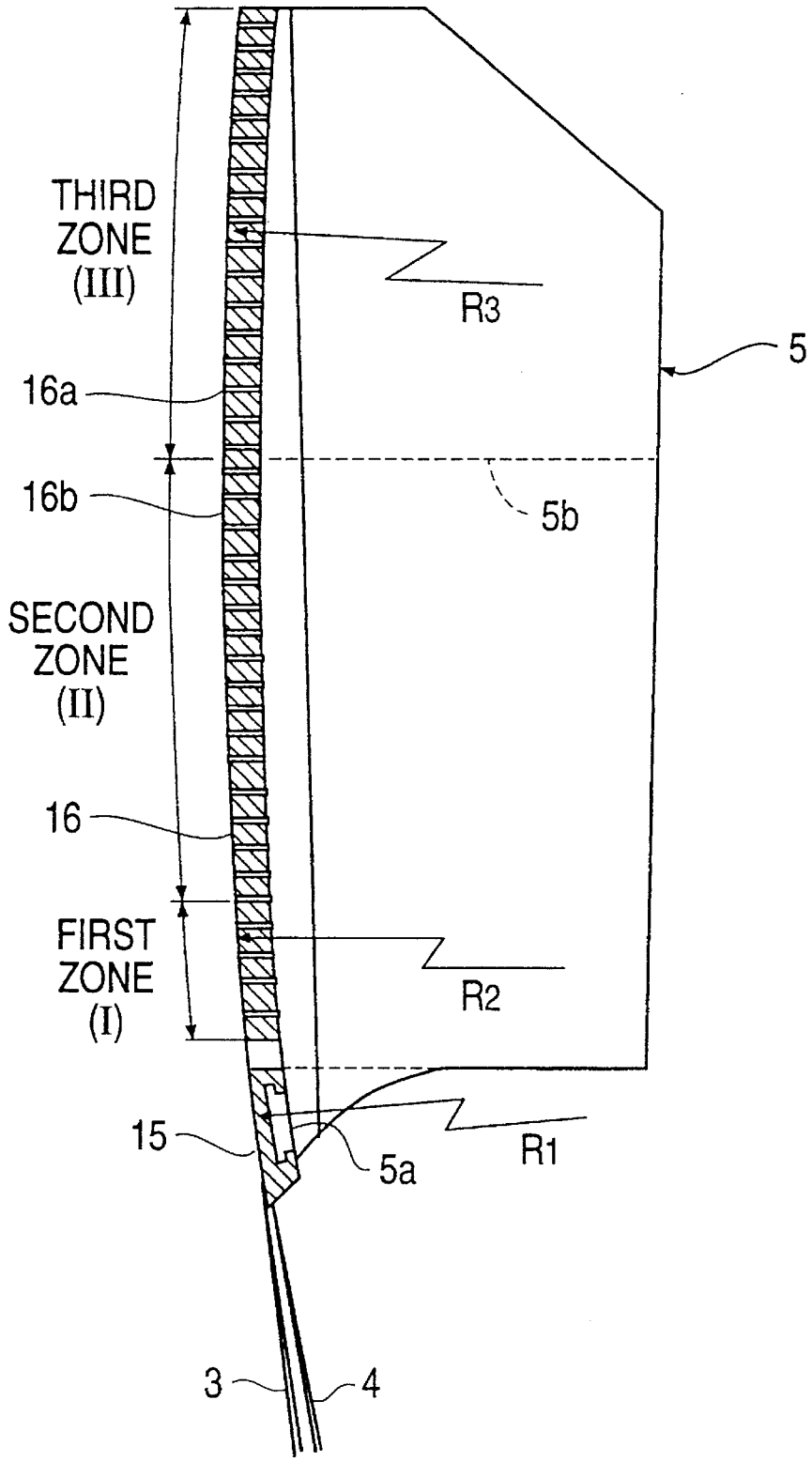
FIG. 5 is a sectional front view showing a conventional dewaterer.

The raw material liquid sandwiched between the wires 3 and 4 enters a dewatering zone disposed continuous with the first blade 15 on the downstream side thereof. In FIG. 5, this dewatering zone consists of a perforated plate 16 comprising multiple slots 16*a* alternating with multiple land portions 16*b*, both continuous in the width direction. This dewatering zone is divided into three zones disposed in order from upstream to downstream: a first zone (I), a second zone (II) and a third zone (III). The land upper surface of the first zone (I) which supports the wire 4 curves convexly on the wire 4 side with a radius of curvature $R_2$, the land upper surface of the second zone (II) which supports the wire 4 is flat, and the land upper surface of the third zone (III) which supports the wire 4 curves convexly on the wire 4 side in the same direction as the first zone (I) with a radius of curvature $R_3$. The second zone (II) between the first zone (I) and the third zone (III) is partitioned by a partition 5*b*, and the first zone (I) together with the second zone (II) and separately from these the third zone (III) are respectively connected to different vacuum sources. The above-mentioned first through third zones (I), (II) and (III) may consist of the same perforated plate or may alternatively for convenience of manufacture each be constituted by a separate perforated plate.

Next the raw material liquid moves to the second dewaterer 6 disposed inside the loop of the wire 3 and is dewatered by the action of a dewatering element installed there. The dewaterers shown in FIG. 8 and FIG. 9 can be used as this second dewaterer 6.

Figure 8:
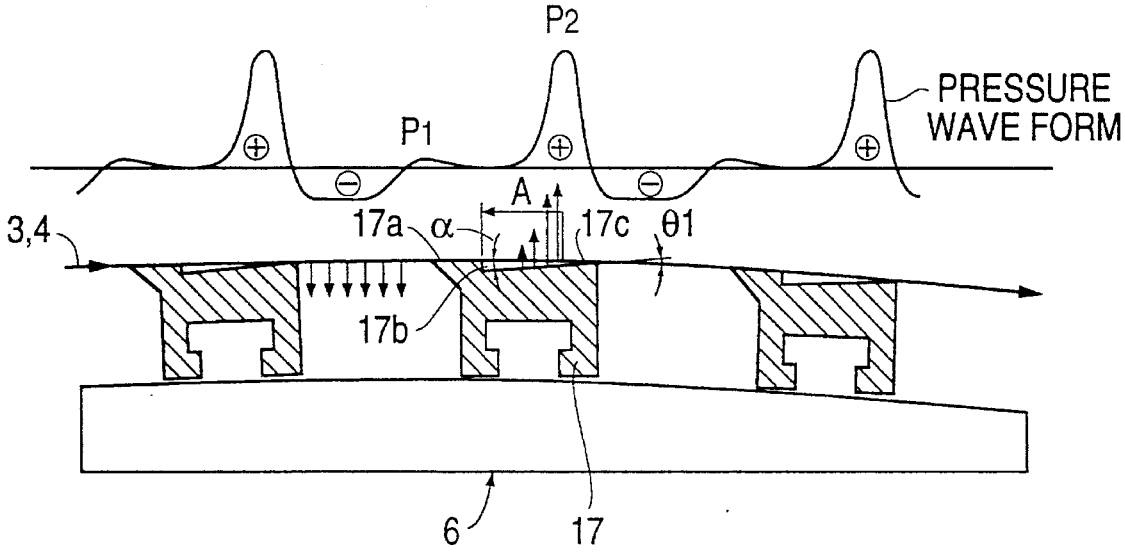
FIG. 8 is a view showing in cross-section another conventional dewaterer and a pressure waveform associated therewith.

This second dewaterer 6 is a conventional dewaterer, and in a first example thereof shown in FIG. 8, because the wires 3 and 4 sandwiching the raw material liquid move past the front edge 17*a* of a shoe blade 17 without being bent by that leading edge, a large pressure is not developed, the pressure which does develop is just a small pressure $P_1$ resulting from the impact reaction of the white water, and the shear force exerted on the mat between the wires is also small. Consequently the dewatering effected by causing a vacuum to act between the shoe blades 17 is dewatering which is away from the fiber dispersion location and is close to static dewatering, and is of high yield.

The wires 3, 4 sandwiching raw material liquid having passed the shoe blade front edge 17*a* bend through an angle $B_1$ at the front end of the rear edge 17*c*. At this time a pulse pressure develops and redispersion of the fiber is promoted. The peak value of this pulse pressure can obviously be changed by changing the shape parameters (A, $\alpha$) which determine the size and shape of the wedge-shaped space formed between the wire 3 and a land portion 17*b* obtained by making the portion of the shoe blade 17 between the front edge 17*a* and the rear edge 17*c* sloped. (The dewaterer 6 of FIG. 8 is shown with its array direction on the opposite side with respect to the wires 3, 4 to FIG. 1.)

Figure 9:
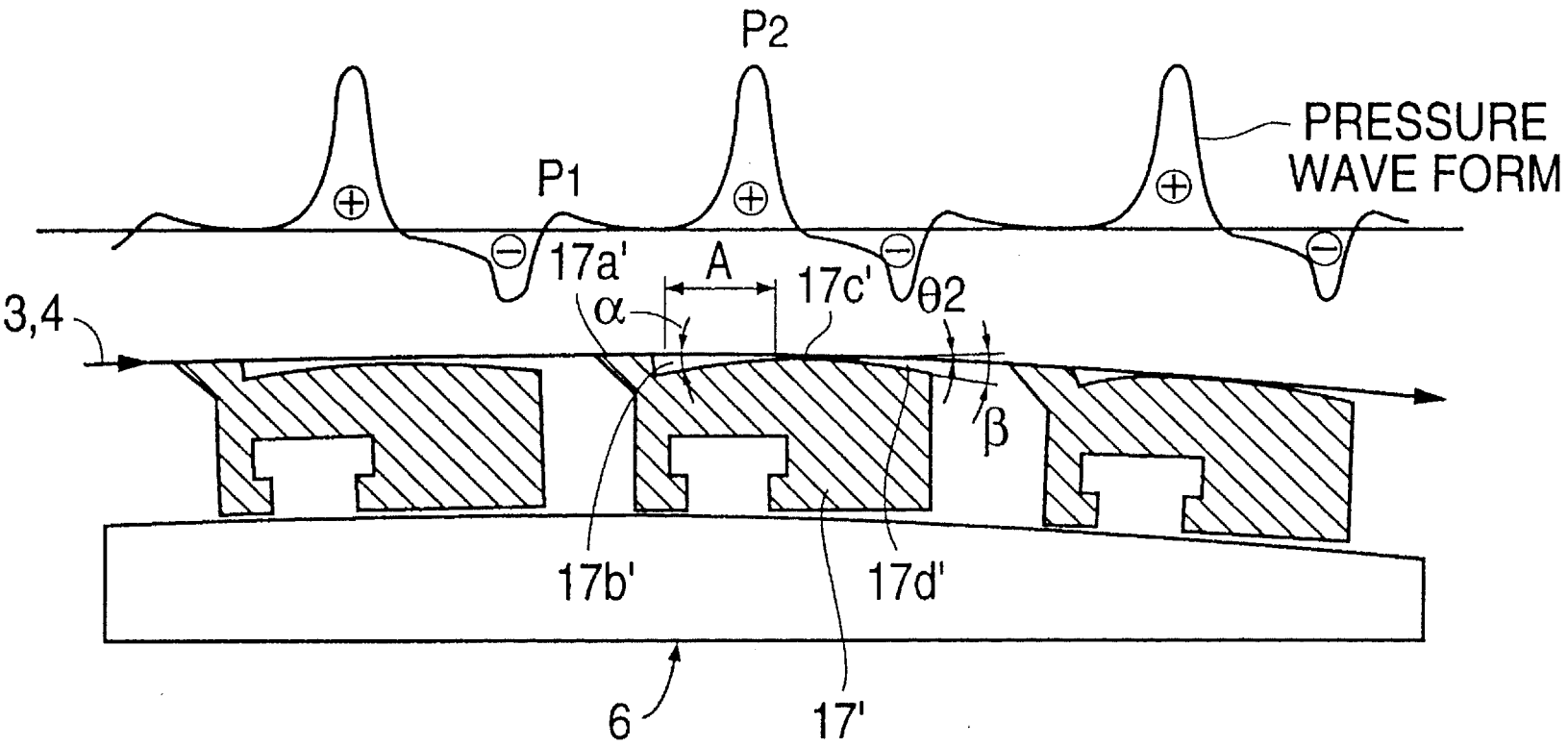
FIG. 9 is a view showing in cross-section a conventional dewaterer different from that of FIG. 8 and a pressure waveform associated therewith.

FIG. 9 shows an example of another conventional dewaterer 6 different from that of FIG. 8, wherein the construction and functions of the front edge 17*a'*, the land portion 17*b'* and the rear end 17*c'* are the same as in FIG. 8. In addition to this the shoe blade 17 has a land portion 17*d'* which slopes downstream in the same way as a Fourdrinier foil blade, and because dewatering can be effected by the vacuum force generated in the space formed by this land and the wire 3, it is possible to economize on vacuum sources. As in the Fourdrinier case, it is possible to adjust the dewatering force by changing the angle $\beta$.

Because by disposing the first and second dewaterers 5 and 6, having the actions described above, inside the wire loops 3 and 4 alternately the action of the shoe blades acts from both sides of the wet paper, a mat whose front and back sides are of the same quality is formed. The mat formed in this way passes over the third dewaterer 7 and has its density further increased before arriving at the couch roll 8.

Also, because the dewatering zone formed by the first to third dewaterers 5, 6, 7 is long and has a sufficient dewatering capability, a plain solid roll can be used instead of the suction roll for the couch roll 8, and problems such as breaking up of the wet paper at high speed do not occur.

Further, although the dewatering zone is long, because the dewatering zone is disposed at an incline, the position of the couch roll is approximately the same as it is conventionally and the height of the machine is not increased. By the couch roll 8 being made a solid roll and the curved transfer suction box 9 being disposed behind the couch roll and the wire 3 being removed from the wet paper as it passes over the transfer suction box 9, the wet paper remains on the wire 4 and is transported to the presspart of the next step.

When the wires 3, 4 are to be replaced, by pivoting the second dewaterer 6 inside the wire loop 3 about a point in the vicinity of the rear end 6*a* thereof by means of the worm jack 12-1 and swinging down the third dewaterer 7, the couch roll 8 and the transfer suction box 9 mounted on the swing arm 13 disposed inside the loop of the wire 4 by means of the worm jack 12-2, space between the devices is made and at the same time a large margin for installing the wires is obtained.

As described above, with the present invention, because the radii of curvature of the dewaterers are large and the dewaterers are disposed sequentially alternately inside the loops of one wire and the other wire and the dewatering zone is long, gentle and front/back-symmetrical, dewatering can be achieved and paper with good yield and excellent front/back similarity can be obtained.

Furthermore, because the couch roll is a solid roll and a curved transfer suction box is disposed behind the couch roll, the initial cost and running costs are lower compared to a conventional case wherein a suction roll is used, and because there is provided a swing arm and the couch roll and the transfer suction box and the dewaterer in front of the couch roll are mounted thereon, and this swing arm is swung down by means of a worm jack, space between the devices can be made and a large margin for installing the wires can be obtained. As a result, with this invention, by means of the sloping dewatering zone arrangement and the swing down structure for wire replacement, the height required for installation of the machine can be reduced.

What is claimed is:

1. A twin wire former of a paper machine, comprising:

a first loop of wire;

a second loop of wire mounted adjacent said first loop of wire, such that a wire run of said first loop of wire is adjacent a wire run of said second loop of wire along a section, said wire runs being disposed diagonally along said section;

a head box, from which a raw material jet is sprayed onto said wires, provided at a lower end of said section;

a couch roll provided at an upper end of said section;

at least three stationary dewaterers disposed sequentially alternately inside said first loop of wire and said second loop of wire along said section between said head box and said couch roll, one of said at least three stationary dewaterers being disposed adjacent said couch roll;

a pivotal swing arm pivotable between a use position and a wire replacement position, said couch roll and said one of said at least three stationary dewaterers being mounted on said pivotal swing arm; and a transfer suction box disposed on a side of said couch roll opposite said one of said at least three stationary dewaterers and also mounted on said pivotal swing arm for pivotal movement therewith.

2. A twin wire former as recited in claim 1, wherein said couch roll is a solid roll; and said transfer suction box is a curved transfer.

3. A twin wire former as recited in claim 2, wherein the wire of one of said first and second loops of wire moves away from wet paper disposed between the wires of said first and second loops of wire along said transfer suction box.

4. A twin wire former as recited in claim 1, further comprising a worm jack mounted to said pivotal swing arm for pivoting said pivotal swing arm.

5. A twin wire former as recited in claim 4, further comprising a second worm jack, a second of said at least three dewaterers being mounted on a second swing arm and said second swing arm being mounted to said second worm jack.

* * * * *